US005793330A

United States Patent [19]

Gans et al.

[11] Patent Number: 5,793,330

[45] Date of Patent: Aug. 11, 1998

[54] INTERLEAVED PLANAR ARRAY ANTENNA SYSTEM PROVIDING OPPOSITE CIRCULAR POLARIZATIONS

[75] Inventors: Lawrence S. Gans, Sparta; Leonard Schwartz, Montville, both of N.J.

[73] Assignee: GEC-Marconi Electronic Systems Corp., Totowa, N.J.

[21] Appl. No.: 754,244

[22] Filed: Nov. 20, 1996

[51] Int. Cl.[6] ..... H01Q 1/38

[52] U.S. Cl. ..... 343/700 MS; 343/756

[58] Field of Search ..... 343/700 MS, 756, 343/770, 795, 797, 853, 814; H01Q 1/38, 21/28, 21/30

[56] References Cited

U.S. PATENT DOCUMENTS

| | | | |
|---|---|---|---|
| 3,775,771 | 11/1973 | Scherer | 343/770 |
| 4,644,360 | 2/1987 | Mead et al. | 343/700 MS |
| 4,772,890 | 9/1988 | Bowen et al. | 343/700 MS |
| 5,181,042 | 1/1993 | Kaise et al. | 343/700 MS |
| 5,596,336 | 1/1997 | Liu | 343/770 |

OTHER PUBLICATIONS

L. Young, L.A. Robinson and C.A. Hacking, "Meander--Line Polarizer", IEEE Transactions on Antennas and Propagation, vol. 23, May 1973, pp. 376–578.

"Analysis and Design of Series–Fed Arrays of Printed–Dipoles Proximity–Coupled to a Perpendicular Microstrip-line", N.K. Das and D.M. Pozar, IEEE Transactions on Antennas and Propagation, vol. 37, No. 4, pp. 435–444.

*Primary Examiner*—Michael C. Wimer
*Assistant Examiner*—Tan Ho
*Attorney, Agent, or Firm*—David L. Davis

[57] ABSTRACT

An interleaved planar array antenna system providing opposite circular polarizations comprises an array of parallel rows of parallel spaced transmit dipole radiating elements and an array of parallel rows of parallel spaced receive dipole radiating elements. Both sets of dipole elements are on the same surface, with the receive dipole elements being oriented orthogonal to the transmit dipole elements and the rows of transmit and receive elements being interleaved. On another surface parallel to and spaced from the first surface, there is at least one transmit feed line which is proximity coupled to the transmit dipole elements and at least one receive feed line which is proximity coupled to the receive dipole elements. Polarizing means are spaced from and overly the transmit and receive dipole elements for transforming orthogonally oriented linearly polarized transmit and receive beams into oppositely circularly polarized transmit and receive beams.

14 Claims, 5 Drawing Sheets

INTERLEAVED PLANAR ARRAY ANTENNA SYSTEM PROVIDING OPPOSITE CIRCULAR POLARIZATIONS

BACKGROUND OF THE INVENTION

This invention relates to planar antenna systems and, more particularly, to such a system for providing a pair of oppositely circularly polarized beams.

Antennas for use in satellite communications systems are generally required to operate over two frequency bands—one for the uplink (i.e., transmitting to the satellite) and the other for the downlink (i.e., receiving from the satellite). Further, the uplink (or transmit) and downlink (or receive) beams have different polarizations. Any antenna used for satellite communications must incorporate these features, in addition to providing adequate signal strength and the proper radiation pattern (beamwidth, sidelobes, etc.) for distinguishing between satellites. It is therefore an object of the present invention to incorporate both uplink and downlink features in a single, low cost, lightweight, antenna.

In a particular application, the transmit and receive beams have opposite-sense circular polarizations. It is therefore another object of this invention to provide an antenna which accommodates such polarizations.

The antenna for this application has a fixed beam, and so the antenna itself must physically be moved in order to change beam pointing direction. Therefore, when used in an aircraft, the antenna must be mounted to a two-axis positioner rather than fixedly to the "skin" of the aircraft. The positioner and antenna are enclosed by a low profile radome (or "bubble") projecting out of the skin of the aircraft fuselage. Antenna weight is an important consideration, not only for the usual reason of aircraft fuel economy, but also for ease and speed of positioning. The size or profile of the antenna is another prime consideration; the antenna must be large enough to provide required gain, but can only protrude minimally out of the aircraft. Printed circuit construction and the long, narrow aperture configuration satisfy these weight and profile requirements. It is therefore a further object of this invention to provide a printed circuit antenna satisfying all of the above requirements.

SUMMARY OF THE INVENTION

The foregoing and additional objects are attained in accordance with the principles of this invention by providing an antenna system comprising an array of parallel spaced transmit dipole elements and an array of parallel spaced receive dipole elements, both on a first surface, with the receive dipole elements being oriented orthogonal to the transmit dipole elements. On a second surface parallel to and spaced from the first surface there is at least one transmit feed line which is proximity coupled to the transmit dipole elements and at least one receive feed line which is proximity coupled to the receive dipole elements. There is further provided polarizing means spaced from and overlying the transmit and receive dipole elements for transforming orthogonally oriented linearly polarized transmit and receive beams into oppositely circularly polarized transmit and receive beams.

In accordance with an aspect of this invention, each of the transmit feed lines is orthogonal to each of the transmit dipole elements at each location at which it is proximity coupled and each of the receive feed lines is orthogonal to each of the receive dipole elements at each of the locations at which it is proximity coupled.

In accordance with another aspect of this invention, the polarizing means includes a meander-line polarizer.

In accordance with a further aspect of this invention, the antenna elements are printed circuit elements on dielectric substrates.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
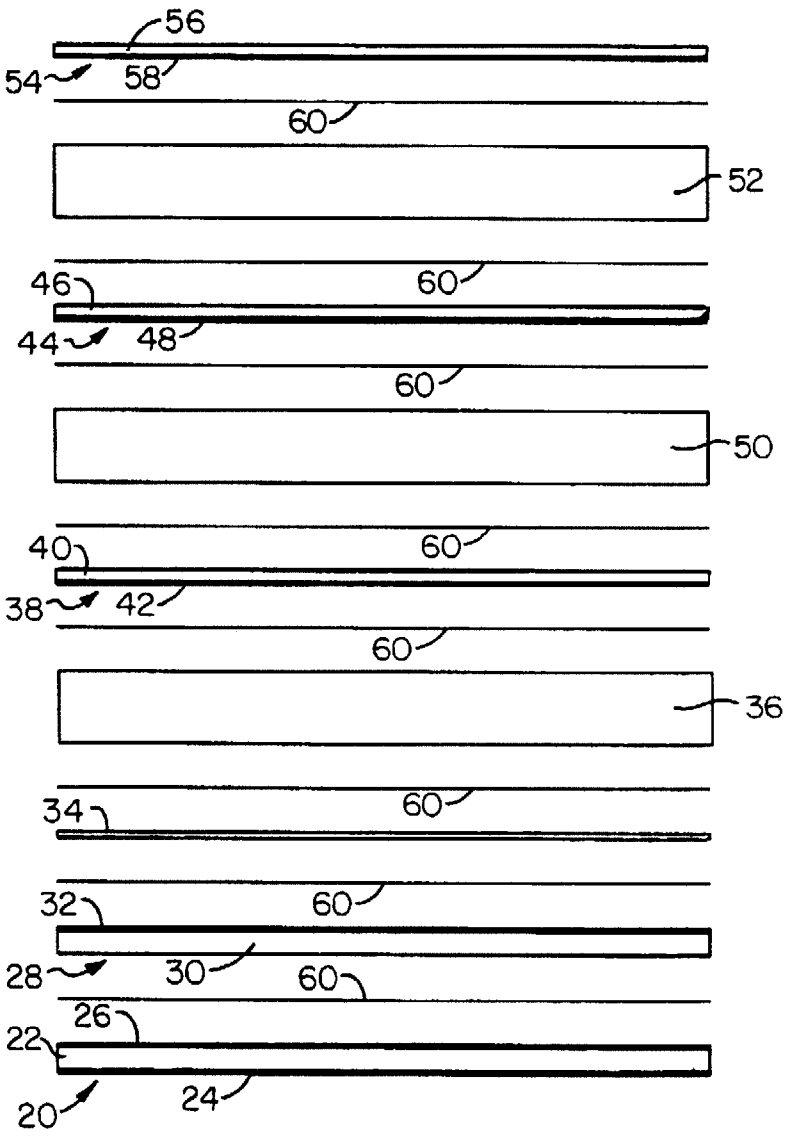
FIG. 1 is an exploded side view identifying the different layers of an illustrative embodiment of an antenna system constructed in accordance with the principles of this invention.

Referring now to the drawings, the inventive antenna is constructed of multiple layers of copper-clad, Teflon-based, temperature-stable dielectric sheet material. The antenna feed lines and radiating elements and the polarizer grid lines are all etched from the copper-clad material. The layers are stacked and bonded together by means of a film adhesive and dielectric foam sheets are used as spacers between the polarizer layers. FIG. 1 shows the layers for the inventive antenna. The first layer 20 includes a dielectric laminate substrate 22 having copper cladding on both its major surfaces. On the lower surface, the copper cladding 24 remains intact as a ground plane for the antenna, whereas on the upper surface, the copper cladding is etched to provide feed lines 26 for the antenna's radiating elements. The second layer 28 includes a dielectric laminate substrate 30 which has copper cladding only on its upper surface, this copper cladding being etched to form radiating elements 32 of the antenna. The third layer 34 comprises an uncladded dielectric laminate cover for the antenna. Overlying the cover 34 is a dielectric foam spacer 36. Above the spacer 36 is the first polarizer layer 38 which includes a dielectric laminate substrate 40 which is copper clad on its lower surface, the copper cladding being etched to form polarizer grid lines 42. Above the first polarizer layer 38 is a second polarizer layer 44 which likewise includes a dielectric laminate substrate 46 having copper polarizer grid lines 48 on its lower surface. A dielectric foam spacer 50 separates the first and second polarizer layers 38, 44. Above the second polarizer layer 44 is another dielectric foam spacer 52. The third and final polarizer layer 54 includes a dielectric laminate substrate 56 whose copper-clad lower surface is etched to provide polarizer grid lines 58. The dielectric laminate substrate 56 of the third polarizer layer 54 serves as the outer skin of the antenna. Between each of the superposed aforedescribed layers is a respective adhesive bonding film 60. To fabricate the aforedescribed antenna, the copper cladding on the dielectric laminates is etched to form the antenna and polarizer elements, then a "sandwich" is made of all the layers with bonding film interposed between adjacent layers. The sandwich is then laminated in a heated press, removed from the press and machined to its final configuration. In an illustrative embodiment, the overall finished size of the antenna is approximately twelve inches wide by thirty inches long by 1.25 inches thick.

Figure 2:
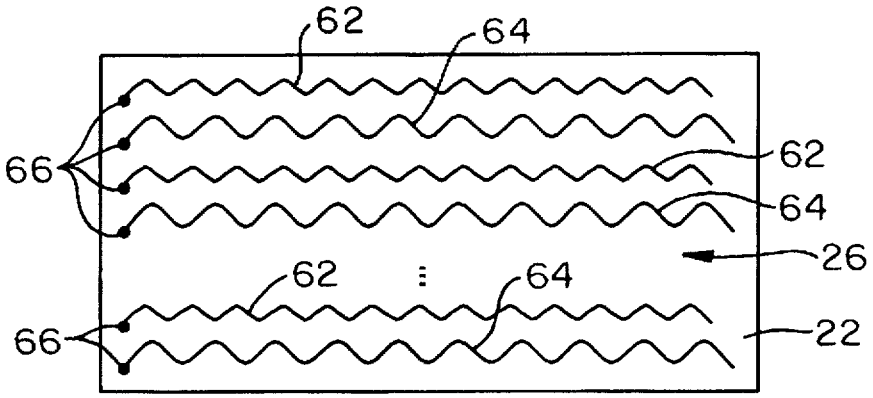
FIG. 2 shows the feed lines of the antenna system of FIG. 1.

FIG. 2 illustrates the feed lines 26 on the substrate 22. As shown, there are transmit feed lines 62 and receive feed lines 64, each of which extends generally along a respective one of a plurality of parallel straight lines, with the transmit feed lines 62 and the receive feed lines 64 being interleaved and alternating with each other. Illustratively, there are twelve each of the transmit and receive feed lines 62, 64. Each of the feed lines 62, 64 has undulations to provide a plurality of parallel evenly spaced segments each at an angle of ±45° to the straight lines (which extend horizontally as viewed in FIG. 2). As will be described in full detail hereinafter, the segments of the transmit feed lines 62 are orthogonal to the segments of the receive feed lines 64. Along one edge of the substrate 22, each of the feed lines 62, 64 is terminated by a respective circular pad 66. The pads 66 are for attachment to respective coaxial connectors (not shown) which are in turn attached to a power distribution network, illustratively of the type shown in FIG. 11, as is conventional. According to the present invention, the feed pads 66 for both the transmit feed lines 62 and the receive feed lines 64 are at the same end of the antenna system. By having all of the feed lines being fed from the same end of the antenna, both the transmit and receive beams will move in the same direction as the transmit and receive frequencies change in the same direction.

Figure 3:
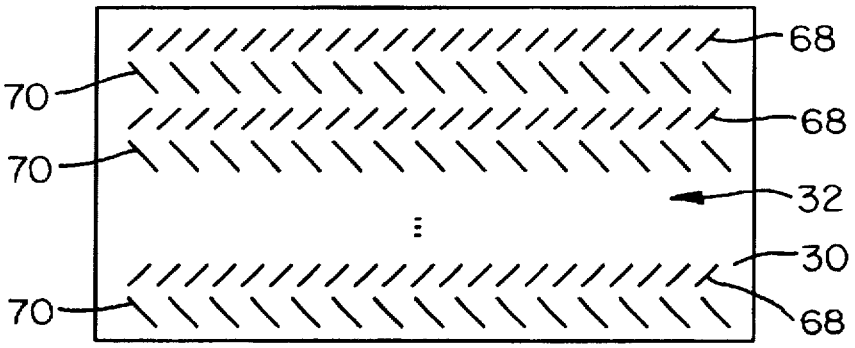
FIG. 3 shows the transmit and receive dipole elements of the antenna system of FIG. 1.

FIG. 3 illustrates the dipole radiating elements 32 on the substrate 30. The radiating elements 32 comprise straight line segments, with the transmit radiating elements 68 each being oriented at an angle of +45° from the vertical (as viewed in FIG. 3) and the receive radiating elements 70 each being oriented at an angle of −45° to the vertical. The transmit radiating elements 68 are arranged in rows along parallel straight lines, as are the receive radiating elements 70, with the rows of the transmit and receive radiating elements 68, 70 being interleaved. Illustratively, there are twelve rows of each of the transmit and receive radiating elements 68, 70. Each of the transmit radiating elements 68 overlies and is orthogonal to a respective one of the transmit feed line segments and each of the receive radiating elements 70 overlies and is orthogonal to a respective one of the receive feed line segments, as will be described in full detail hereinafter.

Figure 4:
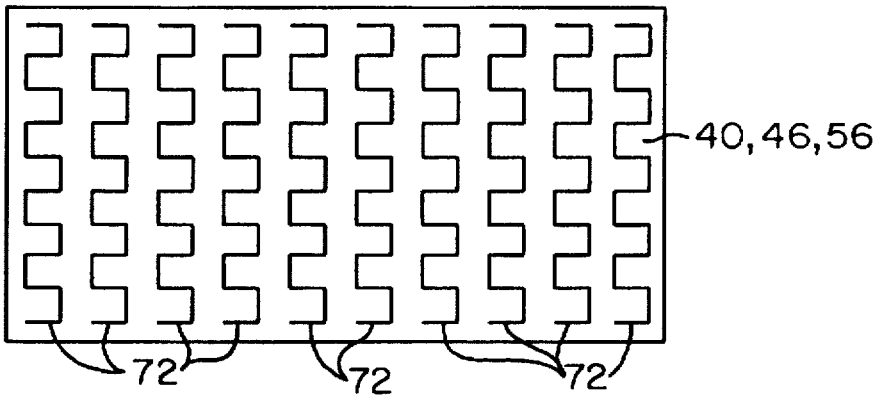
FIG. 4 shows a typical meander-line polarizer of the antenna system of FIG. 1.

FIG. 4 shows a typical meander-line polarizer on one of the substrates 40, 46, 56. Each of the substrates 40, 46, 56 has thereon a plurality of meander-line grid elements 72 extending generally along a plurality of straight lines which are orthogonal to the straight lines described above with respect to the feed lines on the substrate 22 and the radiating elements on the substrate 30.

Figure 6:
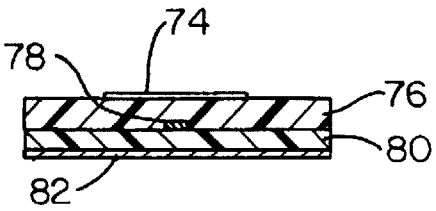
FIG. 6 is a cross sectional view taken along the line 6—6 of FIG. 5.
Figure 5:
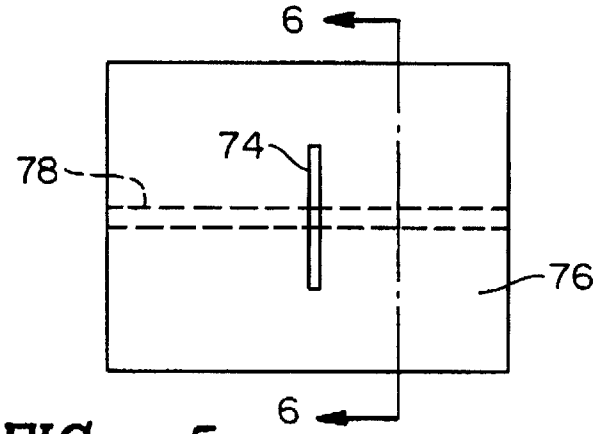
FIG. 5 is a top view generally illustrating proximity coupling of a feed line and a dipole element.
Figure 7:
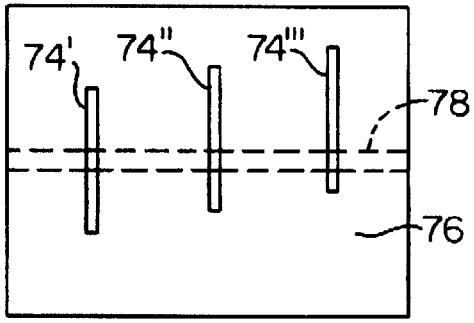
FIG. 7 is a view similar to FIG. 5 showing how to vary the coupling between the feed line and the dipole element.

The antenna on the substrates 22 and 30 operates on the principle of proximity coupling where energy is coupled to the radiating elements from the feed lines by virtue of the close proximity to each other without requiring any direct connection between the feed lines and the radiating elements. FIGS. 5 and 6 illustrate the basic physical configuration for proximity coupling wherein a printed dipole element 74 is printed on a substrate 76 and a feed line 78 is printed on a substrate 80 immediately sub-adjacent to the substrate 76, with a ground plane 82 provided on the lower surface of the substrate 80. The amount of energy coupled between the feed line 78 and the dipole element 74 depends on the amount of offset between the element 74 and the feed line 78. As shown in FIG. 7, the least amount of coupling is provided to the element 74' which is centered over the feed line 78. Maximum coupling is provided to the element 74''' which is almost completely offset from the feed line 78, and an intermediate amount of coupling is provided to the element 74'' which is positioned between the position of the element 74' and the position of the element 74'''. A complete description of the proximity coupled principle is found in the article "Analysis and Design of Series-Fed Arrays of Printed-Dipoles Proximity-Coupled to a Perpendicular Microstripline", N. K. Das and D. M. Pozar, IEEE Transactions on Antennas and Propagation, Volume 37, No. 4, April 1989, pages 435–444, the contents of which are incorporated by reference herein.

As previously described, the sets of interleaved transmit and receive elements 68, 70 are located directly over the transmit and receive feed lines 62, 64, respectively. The elements 68, 70 are oriented at angles of +45° and −45°, respectively, to the vertical, giving the result that the two sets of elements are orthogonal to each other. This is done in order to generate two orthogonally polarized linear signals from the elements 68, 70 which are then transformed into two oppositely circularly polarized signals, as will be described in full detail hereinafter.

Figure 8:
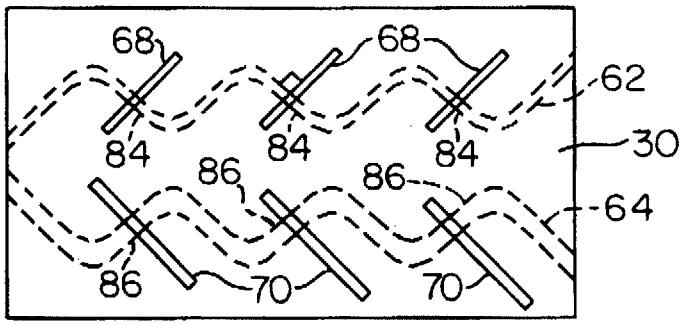
FIG. 8 illustrates the coupling of an array of parallel spaced dipole elements with a feed line according to this invention.

As shown in FIG. 8, the feed lines 62, 64 have undulations so that at the locations where the radiating dipole elements 68, 70 cross the respective feed lines 62, 64, the feed lines have straight segments 84, 86, respectively, which are orthogonal to the elements 68, 70. Thus, the straight segments 84, 86 are orthogonal to each other. The amount of offset between the elements 68, 70 and the respective feed line segments 84, 86 determines the degree of coupling therebetween. Since the offset between the feed lines and the radiating elements controls the amount of coupling (FIG. 7), this effect is utilized to control the radiation pattern to reduce sidelobes to meet sidelobe requirements of the antenna.

In the illustrative embodiment, the transmission frequency band is from 7.90 to 8.40 GHz and the receive frequency band is from 7.25 to 7.75 GHz. Therefore, the transmit and receive radiating elements and feed lines are designed to operate in their respective frequency bands. As is well known, the physical size of each element determines its frequency of operation, with a higher frequency of operation resulting in smaller dimensions. The length of each dipole element is nominally one-half the effective wavelength in the dielectric at the center frequency of its respective frequency band. The spacing between the radiating elements in each row is less than one wavelength, resulting in travelling-wave arrays. The pointing angles of the beams generated by the transmit and receive arrays will therefore move in the azimuth direction as the frequency changes. Since both the transmit and receive feed lines 62, 64 are fed from the same end, this movement will be in the same direction as the transmit and receive frequencies change in the same direction. The actual element spacing for the two sets of arrays are chosen so that the transmit and receive beams are at the same pointing angle at the centers of the two different 500 MHz frequency bands. As the frequency changes up or down, the pointing angles will change, but the two beams will remain approximately coincident (to within about 0.1° for a 3.5° to 4° beam width) as long as the transmit and receive frequencies are at approximately the same position in their respective bands.

The polarizer layers 38, 44, 54 function to convert the orthogonal linearly polarized signals from the radiating elements 68, 70 into oppositely circularly polarized beams. In the illustrative embodiment, the transmit beam is left-hand circularly polarized and the receive beam is right-hand circularly polarized. The polarizer layers are each made up of a respective meander-line polarizer. The operation of such a polarizer is well known in the art and the reader is referred to the article by L. Young, L. A. Robinson and C. A. Hacking, "Meander-Line Polarizer", IEEE Transactions on Antennas and Propagation, Volume 23, May 1973, pages 376–378, the contents of which are incorporated by reference herein.

Figure 9D:
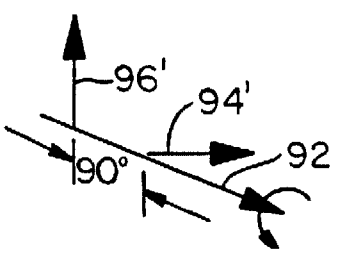
FIGS. 9A–9D are useful for understanding how a meander-line polarizer transforms a linearly polarized beam into a circularly polarized beam.
Figure 9C:
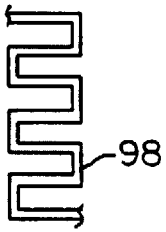
Figure 9B:
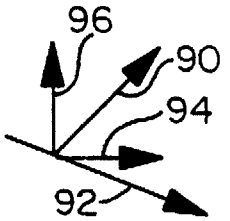
Figure 9A:
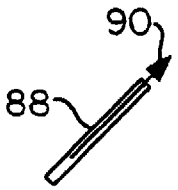
Figure 10B:
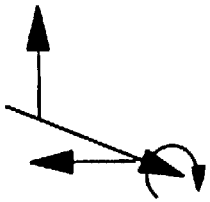
FIGS. 10A and 10B illustrate the transformation of a beam polarized orthogonally to the beam of FIG. 9A into an oppositely directed circularly polarized beam.
Figure 10A:
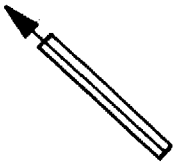

FIGS. 9A–9D provide a graphical illustration of the transformation from linear polarization to circular polarization by a meander-line polarizer. FIG. 9A illustrates a radiating element 88 producing a linearly polarized signal, as shown by the arrow 90. This linearly polarized signal is oriented at +45° from the vertical. As shown in FIG. 9B, the linearly polarized signal shown by the arrow 90 propagates in the direction shown by the arrow 92 and may be considered to have a horizontal component represented by the arrow 94 and a vertical component represented by the arrow 96. When the linearly polarized beam passes through the meander-line polarizer 98 shown in FIG. 9C, the polarizer 98 has the effect of advancing one of the components and retarding the other. The dimensions of the polarizer 98 depend upon the frequency of the signal on which it operates. FIG. 9D illustrates the resultant signal after passing through the polarizer 98, where the arrow 92 represents the direction of propagation of the signal. In this case, the horizontal component and the vertical component of the signal have been displaced 90° out of phase, as indicated by the arrows 94' and 96'. Thus, the polarizer 98 has advanced the horizontal component of the linearly polarized signal and retarded the vertical component of the linearly polarized signal, for a net phase difference of 90°, thereby resulting in a right-hand circularly polarized beam. FIGS. 10A and 10B illustrate the transformation of a linearly polarized beam which is orthogonal to the beam shown in FIG. 9A into a left-hand circularly polarized beam by the same meander-line polarizer 98.

Multiple polarizer layers 38, 44, 54 are used to extend the frequency of operation, as the polarizer must function over both the transmit and receive frequency bands. The dimensions of the different polarizer layers are selected to cover different parts of the bands.

Figure 11:
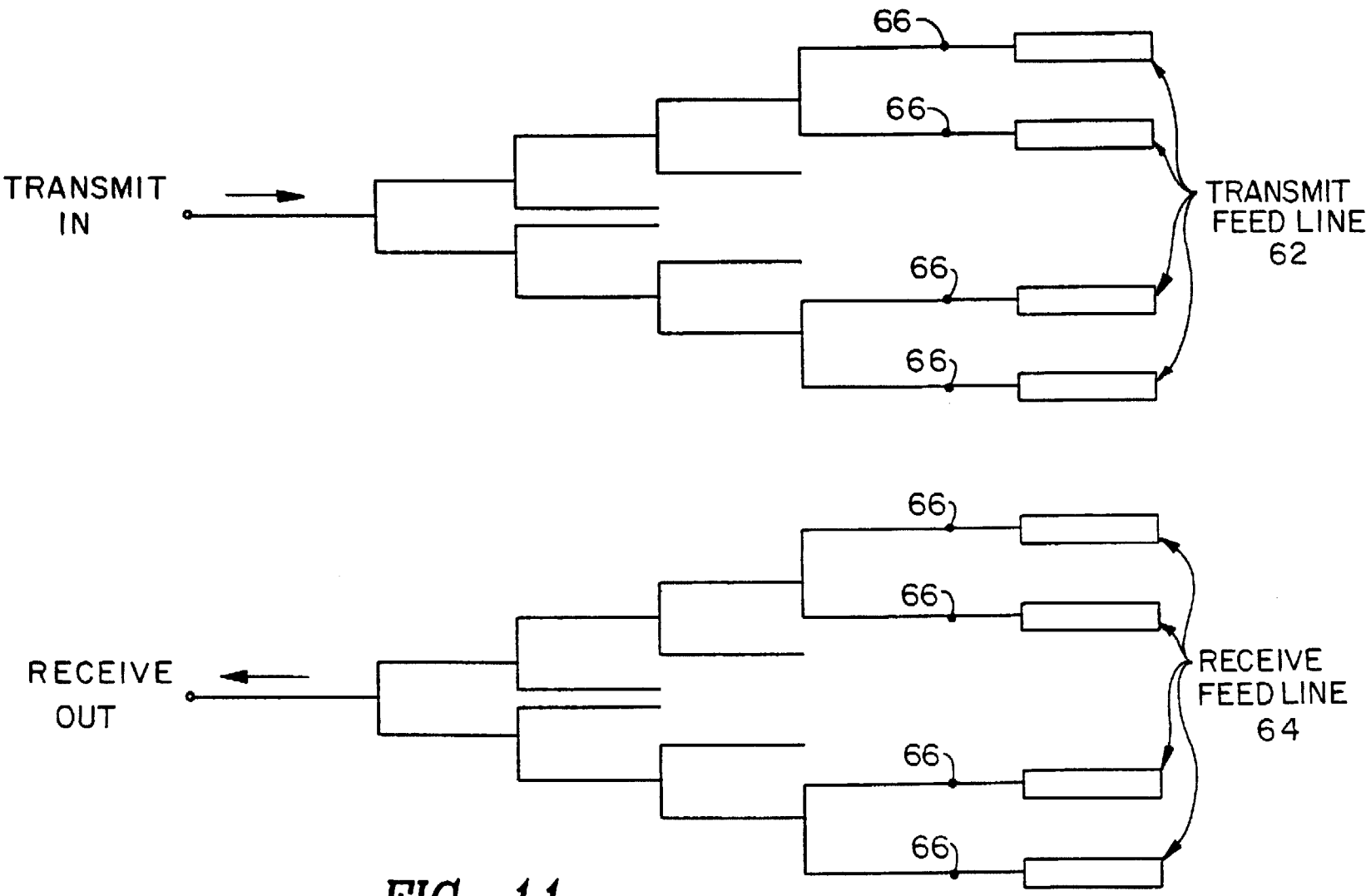
FIG. 11 illustrates a feed for the antenna system of FIG. 1.

FIG. 11 illustrates a conventional corporate feed for the transmit and receive feed lines 62, 64.

An advantage of the aforedescribed antenna is that two frequencies of operation and two circular polarizations are produced from a single layer of printed linear elements. This is made possible by orienting the transmit and receive radiating elements orthogonal to each other, and only a single polarizer need be used. The simple one-line feeding arrangement (i.e., series feeding—where energy goes in one end and is distributed to the radiating elements one after another) occupies a minimal amount of aperture real estate, allowing the interleaving of the two sets of radiating arrays.

Accordingly, there has been disclosed an improved interleaved planar array antenna system providing opposite circular polarizations. The resulting antenna interleaves in a single aperture two sets of series fed radiating dipole elements operating at different frequencies, uses two orthogonal sets of linear elements oriented at ±45° and a single wideband polarizer to generate two different circular polarizations from a single aperture, and uses an undulating feed line in a perpendicular proximity-coupled dipole array to orient the elements at ±45°. Although printed circuit elements have been disclosed herein, one of ordinary skill in the art will appreciate that an equivalent configuration using slots can also be constructed. Therefore, while an illustrative embodiment of the present invention has been disclosed, it is understood that various modifications and adaptations to the disclosed embodiment will be apparent to those of ordinary skill in the art and it is intended that this invention be limited only by the scope of the appended claims.

What is claimed is:

1. An antenna system comprising:

an array of parallel spaced transmit dipole elements on a first dielectric surface;

an array of parallel spaced receive dipole elements on said first surface, said receive dipole elements being oriented orthogonal to said transmit dipole elements;

at least one transmit feed line on a second dielectric surface parallel to and spaced from said first surface, said at least one transmit feed line being proximity coupled to said transmit dipole elements;

at least one receive feed line on said second surface proximity coupled to said receive dipole elements; and polarizing means spaced from and overlying said transmit and receive dipole elements for transforming orthogonally oriented linearly polarized transmit and receive beams into oppositely circularly polarized transmit and receive beams.

2. The antenna system according to claim 1 wherein:

each of said at least one transmit feed line is orthogonal to each of the transmit dipole elements at each location at which it is proximity coupled; and each of said at least one receive feed line is orthogonal to each of the receive dipole elements at each location at which it is proximity coupled.

3. The antenna system according to claim 2 wherein the antenna system is adapted for use in a communications system operating over separate transmit and receive frequency bands and wherein:

the length of each transmit dipole element is nominally one-half the effective wavelength in the dielectric at the center frequency of the transmit frequency band; and the length of each receive dipole element is nominally one-half the effective wavelength in the dielectric at the center frequency of the receive frequency band.

4. The antenna system according to claim 2 wherein:

the transmit dipole elements associated with each of said at least one transmit feed line lie along a respective straight line and are spaced closer than one wavelength of the highest frequency of the transmit frequency band;

the receive dipole elements associated with each of said at least one receive feed line lie along a respective straight line and are spaced closer than one wavelength of the highest frequency of the receive frequency band; and wherein all of said straight lines are parallel;

whereby travelling wave arrays are provided.

5. The antenna system according to claim 4 wherein the at least one transmit feed line is interleaved with the at least one receive feed line.

6. The antenna system according to claim 5 wherein said polarizing means includes a meander-line polarizer comprising a plurality of meander-lines extending generally along a plurality of parallel straight lines orthogonal to the straight lines associated with the transmit and receive feed lines.

7. The antenna system according to claim 6 wherein said polarizing means includes a plurality of overlying meander-line polarizers each dimensioned for a respective portion of the transmit and receive frequency bands.

8. A planar printed circuit antenna system for use in a communications system wherein the antenna transmit and receive signals operate over at least one frequency band and are circularly polarized in opposite directions, the antenna system comprising:

a first planar dielectric substrate;

a plurality of transmit feed lines on a first surface of said first substrate and extending generally along a first plurality of parallel straight lines, said plurality of transmit feed lines having undulations so that each of said transmit feed lines includes a plurality of parallel evenly spaced segments each at an angle of forty-five degrees to said plurality of straight lines;

a plurality of receive feed lines on said first surface of said first substrate and extending generally along a second plurality of parallel straight lines interleaved with and parallel to said first plurality of straight lines, said plurality of receive feed lines having undulations so that each of said receive feed lines includes a plurality of parallel evenly spaced segments each orthogonal to said transmit feed line segments;

a second planar dielectric substrate overlying and parallel to said first surface of said first substrate;

a plurality of transmit radiating elements on the surface of said second substrate which is opposite said first substrate, said transmit radiating elements comprising straight line segments each overlying and orthogonal to a respective one of said transmit feed line parallel evenly spaced segments;

a plurality of receive radiating elements on said second substrate opposite surface and comprising straight line segments each overlying and orthogonal to a respective one of said receive feed line parallel evenly spaced segments;

a third planar dielectric substrate overlying and parallel to said second dielectric substrate; and a meander-line polarizer on a surface of said third substrate and comprising a plurality of meander-lines extending generally along a third plurality of straight lines which are orthogonal to said first and second pluralities of straight lines.

9. The antenna system according to claim 8 wherein the spacing between said transmit feed line segments is less than one wavelength of the highest frequency of the transmit frequency band and the spacing between said receive feed line segments is less than one wavelength of the highest frequency of the receive frequency band.

10. The antenna system according to claim 8 wherein the length of each of said transmit radiating element straight line segments is nominally one-half the effective wavelength in the dielectric at the center frequency of the transmit frequency band and the length of each of said receive radiating element straight line segments is nominally one-half the effective wavelength in the dielectric at the center frequency of the receive frequency band.

11. The antenna system according to claim 8 further including:

at least one further planar dielectric substrate overlying and parallel to said third dielectric substrate; and a further meander-line polarizer on a surface of each of said at least one further substrate, each further polarizer comprising a plurality of meander-lines each overlying a respective one of said meander-lines on said third substrate surface.

12. The antenna system according to claim 11 wherein said meander-lines on each of said third and said at least one further substrates are each dimensioned for a respective portion of the at least one frequency band.

13. The antenna system according to claim 8 wherein the spacing between radiating elements associated with respective feed lines is less than one wavelength of the highest frequency of the respective frequency band, whereby travelling wave arrays are provided.

14. The antenna system according to claim 8 wherein all of said feed lines are fed from the same end of the antenna system, whereby both the transmit and receive beams move in the same direction as the transmit and receive frequencies change in the same direction.

* * * * *